US010976140B2

(12) United States Patent
Wood et al.

(10) Patent No.: US 10,976,140 B2
(45) Date of Patent: Apr. 13, 2021

(54) SHORT ROUND FOR LIGHTWEIGHT AUTOMATIC WEAPON

(71) Applicant: Capco, LLC, Grand Junction, CO (US)

(72) Inventors: Stephen K. Wood, Whitewater, CO (US); Matt L. Bryner, Grand Junction, CO (US)

(73) Assignee: CAPCO, LLC, Grand Junction, CO (US)

( * ) Notice: Subject to any disclaimer, the term of this patent is extended or adjusted under 35 U.S.C. 154(b) by 0 days.

(21) Appl. No.: 16/689,776

(22) Filed: Nov. 20, 2019

(65) Prior Publication Data

US 2020/0240755 A1 Jul. 30, 2020

Related U.S. Application Data

(60) Provisional application No. 62/769,817, filed on Nov. 20, 2018.

(51) Int. Cl.
*F42B 5/26* (2006.01)
*F42B 5/02* (2006.01)

(52) U.S. Cl.
CPC ..... *F42B 5/26* (2013.01); *F42B 5/025* (2013.01)

(58) Field of Classification Search
CPC ..... F42B 5/045; F42B 5/184; F42B 5/26
USPC ..... 102/433, 434, 436, 447, 464
See application file for complete search history.

(56) References Cited

U.S. PATENT DOCUMENTS

| | | | | | |
|---|---|---|---|---|---|
| 27,791 | A * | 4/1860 | Foster | F42B 5/26 | 102/464 |
| 3,318,244 | A * | 5/1967 | Rostocil | F42B 5/16 | 102/436 |
| 3,687,077 | A * | 8/1972 | Goldin | F42B 5/184 | 102/433 |
| 5,165,040 | A * | 11/1992 | Andersson | F42B 5/29 | 102/430 |
| 2014/0000471 | A1* | 1/2014 | Carpenter | F42B 5/045 | 102/439 |
| 2015/0300791 | A1* | 10/2015 | Eberhart | F42B 5/28 | 102/469 |
| 2016/0054105 | A1* | 2/2016 | Beal | F42B 5/02 | 102/464 |
| 2016/0223302 | A1* | 8/2016 | Bowers | F42B 5/025 | |
| 2016/0245630 | A1* | 8/2016 | Kedairy | F42B 5/26 | |

* cited by examiner

*Primary Examiner* — Bret Hayes
(74) *Attorney, Agent, or Firm* — Snell & Wilmer L.L.P.; Russell T. Manning

(57) ABSTRACT

An ammunition cartridge having a cup-shaped casing. The cup-shaped casing has a closed reward end with a rearward diameter and an open forward end having a forward diameter that is larger than the rearward diameter. A sidewall extends between the peripheries of the rearward end and the top end of the casing. The sidewall tapers from the smaller rearward diameter to the larger forward diameter along a length of a hollow interior of the casing that holds a propellant charge.

18 Claims, 19 Drawing Sheets

SHORT ROUND FOR LIGHTWEIGHT AUTOMATIC WEAPON

CROSS REFERENCE

The present application claims the benefit of the filing date of U.S. Provisional Application No. 62/769,817 having a filing date of Nov. 20, 2018, the entire contents of which is incorporated herein by reference.

FIELD

Disclosed is a novel ammunition that combines with a novel weapon to form a system that will be lighter, more compact, and more accurate than the current M249 Squad Automatic Weapon (SAW).

BACKGROUND

The M249 light machine gun (LMG), formerly designated the M249 Squad Automatic Weapon (SAW) is a light machine gun that is widely utilized in the U.S. Armed Forces. The weapon was introduced in 1984 after being judged the most effective of a number of candidate weapons to address the lack of automatic firepower in small units. The M249 provides infantry squads with the high rate of fire of a machine gun combined with accuracy and portability approaching that of a rifle.

The M249 is a belt-fed light machine gun that typically fires the 5.56×45 mm NATO cartridge, usually a combination of one M856 tracer and four M855 ball cartridges fed from M27 linked belts. Belts are typically held in a hard plastic or soft canvas box attached to the underside of the weapon. The M249 fires from an open bolt and is gas operated. When the trigger is pulled, the bolt and bolt carrier move forward under the power of the recoil spring. A cartridge is stripped from the belt, chambered, and discharged, sending a bullet down the bore. Expanding propellant gases are diverted through a hole in the barrel into a chamber. This pressure moves a piston providing the energy to extract and eject the spent casing as well as advance the belt and compress the recoil spring, thus preparing for subsequent shots. At 41 inches long and 17 pounds and commonly utilizing a 22 pound 200-round belt and plastic ammo box, the M249 is a cumbersome weapon. Accordingly, it would be desirable to provide a comparable weapon and ammunition having reduced size and weight.

SUMMARY

A driving factor in the size and weight of conventional automatic weapons is the length of the cartridge. Disclosed herein is a novel ammunition design that utilizes cartridge that is nearly 50% shorter and weighs 30% less than a conventional cartridge firing the same projectile. In an arrangement, the CSR utilizes a 6.8 mm projectile. However, it will be appreciated that other caliber projectiles are possible and within the scope of the present disclosure. Generally, the cartridge utilizes a casing that has an aspect ratio that is less the aspect ratio of a conventional cartridge. That is, the cartridge is shorter and wider than a conventional cartridge.

In an aspect, an ammunition cartridge is provided that has a generally cup-shaped case. The cup-shaped case has a close rearward end with a rearward diameter and an open top end having a forward diameter that is greater than rearward diameter. A side wall extends between a periphery of the close rearward end and the top open end. A top plate is attached about the periphery of the top end of the cup-shaped case and extends over a portion of the open end of the cup-shaped case. The top plate further includes a raised annular neck defining aperture aligned with the centerline axis of the cup-shaped case. The raised annular neck defines an aperture configured to receive a projectile (e.g., bullet, tracer, etc.). The size of the aperture of the raised annular neck may be varied depending on projectile size. The top plate may be flat or domed. In any arrangement, the top plate is configured to obturate against a barrel surface.

The sidewall tapers between the smaller rearward diameter and larger forward diameter. The taper angle of the sidewall, relative to a centerline axis of the casing is typically between about 0 degrees and about 15 degrees. In a further arrangement, the taper angle is between about 0 degrees and about 5 degrees. In a yet further arrangement, the taper angle is between about 2 degrees and about 3.5 degrees.

The casing may be formed of separate elements. That is, the cup-shaped case and the top plate. However, in another arrangement these elements may be integrally formed. The casing may further include an annular rim about is upper periphery. In any arrangement, the interior of the cartridge may include propellant disposed therein.

In one arrangement, the closed end of the casing may include an aperture. This aperture may receive a conventional primer. In another arrangement, the aperture may be covered by a rupture disk. In another arrangement, the rearward end of the casing may include a section having a reduced thickness. Such a reduced thickness section may define an integrally formed rupture disk.

The novel ammunition may be utilized in a Lightweight Automatic Weapon (LAW) that features several novel attributes giving it a substantial weight savings when compared to conventional automatic weapon designs. These attributes are considered novel alone as well as in various combinations. One attribute of the LAW is an extremely short-stroke action. While the stroke-length of the action in conventional automatic weapons is typically 2 to 3 times the length of the cartridge it fires, the stroke-length of the LAW is less than 1× the length of the cartridge it fires. A reduced action stroke-length results in a drastically reduced receiver size and overall weapon length.

DETAILED DESCRIPTION

Reference will now be made to the accompanying drawings, which at least assist in illustrating the various pertinent features of the presented inventions. The following description is presented for purposes of illustration and description and is not intended to limit the inventions to the forms disclosed herein. Consequently, variations and modifications commensurate with the following teachings, and skill and knowledge of the relevant art, are within the scope of the presented inventions. The embodiments described herein are further intended to explain the best modes known of practicing the inventions and to enable others skilled in the art to utilize the inventions in such, or other embodiments and with various modifications required by the particular application(s) or use(s) of the presented inventions.

As utilized herein, the term forward refers to elements that will be disposed toward the muzzle of the weapon while the term rearward refers to elements that are disposed toward the buttstock of the weapon.

Figure 1A:
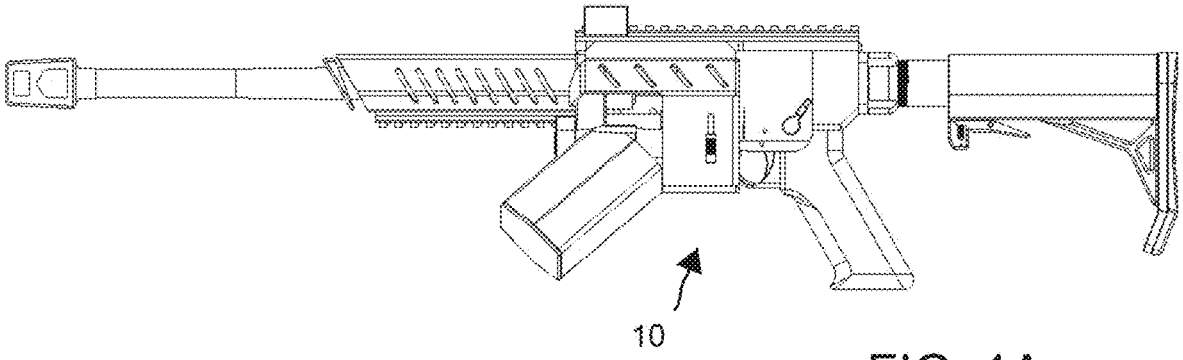
FIGS. 1A and 1B illustrate opposing side views of one embodiment of an automatic or semiautomatic rifle.
Figure 1B:
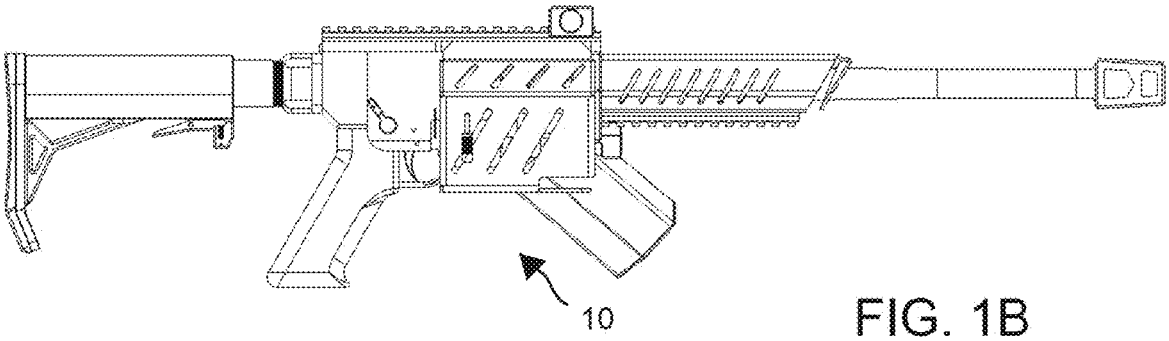
Figure 2A:
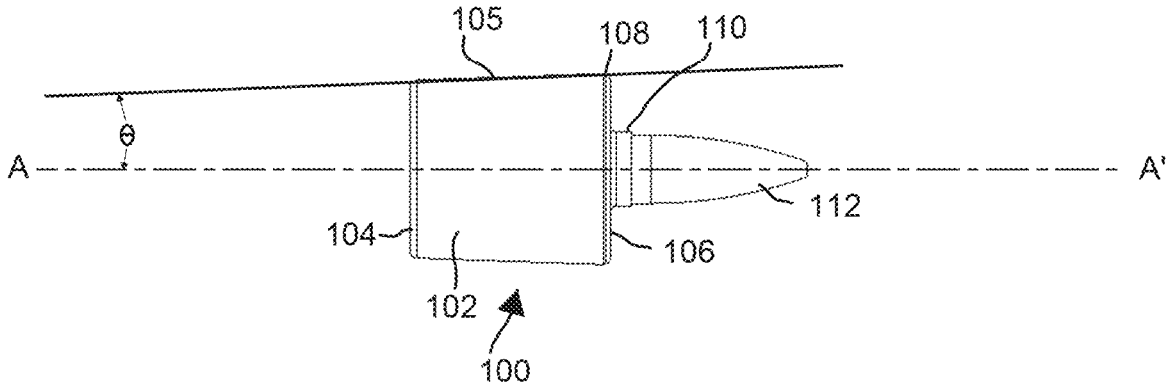
FIGS. 2A-2C illustrate various views of an embodiment of an ammunition cartridge.
Figure 2B:
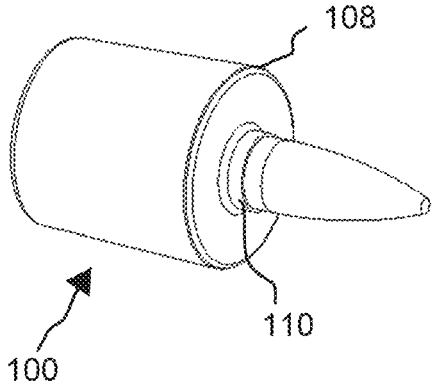
Figure 2C:
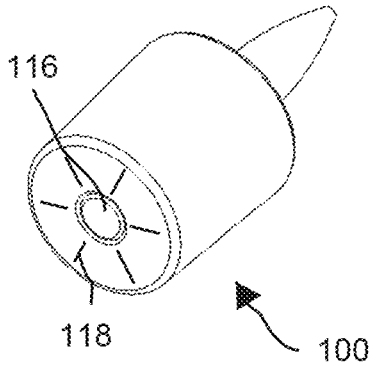

FIGS. 1A and 1B illustrate one embodiment of the Capco Lightweight Automatic Weapon 10 system (LAW), that is designed to utilize a unique forward-ejectable ammunition referred to as the Capco Short Round (CSR) ammunition 100 (FIGS. 2A-2C). Though referred to as an automatic weapon, it will be appreciated that the weapon may be configured as a semiautomatic as well. The CSR ammunition 100 is designed for decreased weight and length compared to conventional ammunition while maintaining the critical advantages of conventional brass and propellants. In the illustrated embodiment, the LAW is a magazine fed, forward-ejecting, short-stroke action, multi-chambered gun that is largely conventional in appearance. In other embodiments, the LAW may be belt fed.

CSR Ammunition

Figure 2D:
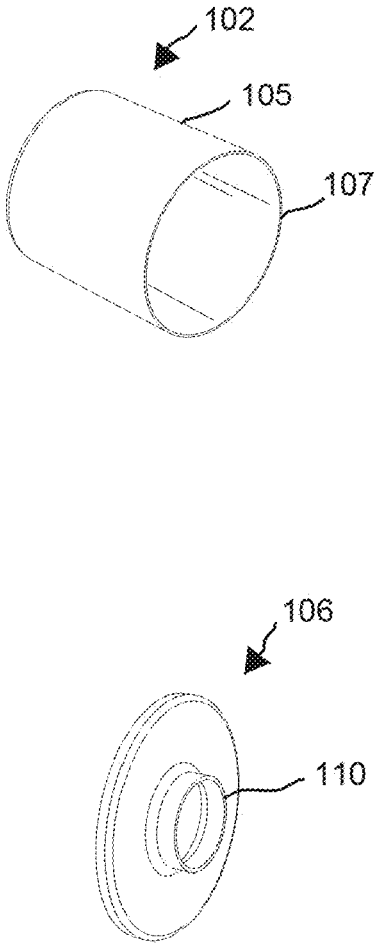
FIGS. 2D and 2E illustrate various views of an embodiment of a casing of the cartridge of FIGS. 2A-2C.
Figure 2E:
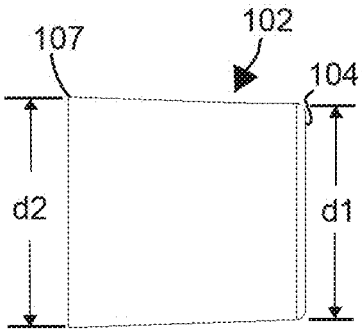
Figure 2E:
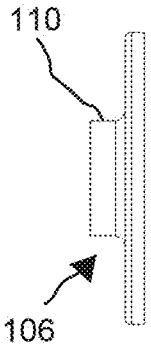

The CSR ammunition/cartridge 100 concept is adaptable to any caliber and is designed for fully-automated manufacturing. The cartridge uses a thimble-shaped cup or case 102 that replaces the traditional brass case of conventional ammunition and serves to house and protect a propellant charge. As various illustrated in FIGS. 2A-2E the cup or thimble shaped case 102 is a generally cylindrical hollow housing that, when connected to a forward face plate or face 106, defines an enclosure that houses a propellant charge and supports a bullet. The generally cylindrical case 102 tapers, in the present embodiment, from a smaller diameter $d_1$ at or near a closed rearward end 104 to a larger diameter $d_2$ at or near an open top peripheral edge 107. See FIG. 2E. That is, the casing has a sidewall 105 that tapers over at least a portion of the distance between the rearward end 104 and the forward top edge 107. In an embodiment, the sidewall tapers continuously between the rearward end and the forward edge. This tapered sidewall typically has a taper angle Θ relative to a centerline axis A-A' of the case 102. The taper angle Θ is typically between about 0 degrees and about 15 degrees. In a further embodiment, the taper angle Θ is between about 0 degrees and about 5 degrees. In a yet further embodiment, the taper angle Θ is between about 2 degrees and about 3.5 degrees. This tapered sidewall assists in the forward ejection of the casing 102, when the casing is received in a correspondingly tapered chamber. The tapered design reduces the friction between the casing and the chamber facilitating its ejection. However, in alternate embodiments, the casing need not be continuously tapered and may take different profiles that may vary over the length of the sidewall. Of further note, embodiments of the LAW may utilize cartridges without a tapered sidewall. In the illustrated embodiment, the face 106 is connected about its outer periphery to the periphery of the top edge 107. In an embodiment, this connection is formed in a crimping process. The connection between the face 106 and the case 102 defines and annular rim 108 that extends about the periphery of the cartridge. See FIGS. 2A and 2B. The face plate 106 has a generally flat annular portion surrounding a raised annular neck 110. See FIGS. 2D and 2E. The face plate 106 defines the forward end of the combined casing (e.g., case and face plate). In an embodiment, the annular rim of the face plate is generally flat however other shaped (e.g., domed) are possible. In any embodiment, the face plate 106 includes the raised annular neck 110 defining a central aperture that is sized to hold a projectile 112 in a partially telescoped configuration. The central aperture is aligned with a centerline axis of the cartridge. The CSR case 102 easily accommodates conventional ball, tracer, blank, live fire, force-on-force and drill type projectiles. In a further embodiment, the cup 102 and face plate 106 may be a single integrally formed element.

Figure 2F:
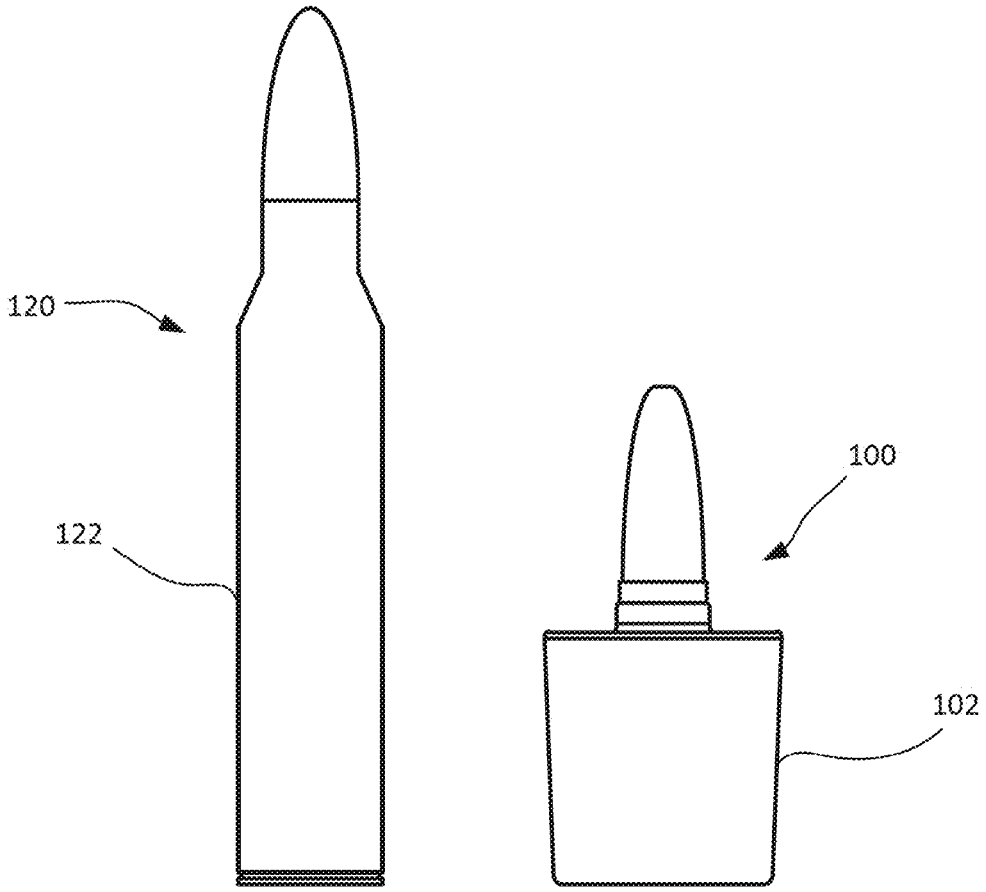
FIG. 2F illustrates a comparison between the presented ammunition cartridge and a prior art cartridge.

A significant advantage of CSR ammunition 100 includes improved volumetric efficiency of the cartridge. By increasing the case diameter of the cartridge 100 compared to conventional ammunition, the ratio of a volume of the casing to its surface area increases, reducing the amount of brass (or other material) necessary to hold a specific amount of propellant. The unique geometry of the CSR also significantly reduces its length compared to conventional ammunition. That is, as shown in FIG. 2F, the CSR case 102 is significantly shorter than a standard ammunition casing 122 of an M855 ammunition cartridge 120 designed for use in the M249 SAW while having casing diameter that is significantly greater than the standard ammunition casing 122. However, the CSR case 102 may have an interior volume for housing propellant that is equal to or greater than an interior volume of the casing 122 of the M855 cartridge.

The overall length of the prior art M855 cartridge 120 is 2.25 inches most of which is the casing. The casing length in conjunction with loading the casing into a rearward end of a firing chamber requires that the action of the M249 SAW travel approximately 5.5 inches during each firing cycle. In contrast, a CSR cartridge of the same caliber has an overall length from the rearward end 104 of the casing 102 to the tip of the projectile 112 of approximately 1.75 inches with a casing that is approximately one-half (or less) of the length of the M855 casing. This allows the action of the LAW to operate on a stroke-length of no more than 2.0 inches resulting in a 40-65% reduction of travel distance for the action of the LAW. The reduced length of the CSR ammunition 100 enables use of a lighter weight weapon, as it allows for significantly reduced action length in an action of an automatic or semiautomatic weapon utilizing the CSR ammunition. The CSR ammunition 100 may be used in a magazine configuration, a belt feed application and/or a bolt action configuration.

The unique design of the CSR ammunition 100 provides significant weight reduction without the use of unconventional materials such as polymers. While polymers tend to be hygroscopic and exhibit aging, brass has proven to be an extremely robust and reliable material for encasing and protecting the propellant charge. The hermetic seal provided by brass, its manufacturability, material availability, storage requirements, and performance characteristics are well understood. However, it will be appreciated that other convention metals and/or unconventional materials such as polymers may be utilized.

Figure 3A:
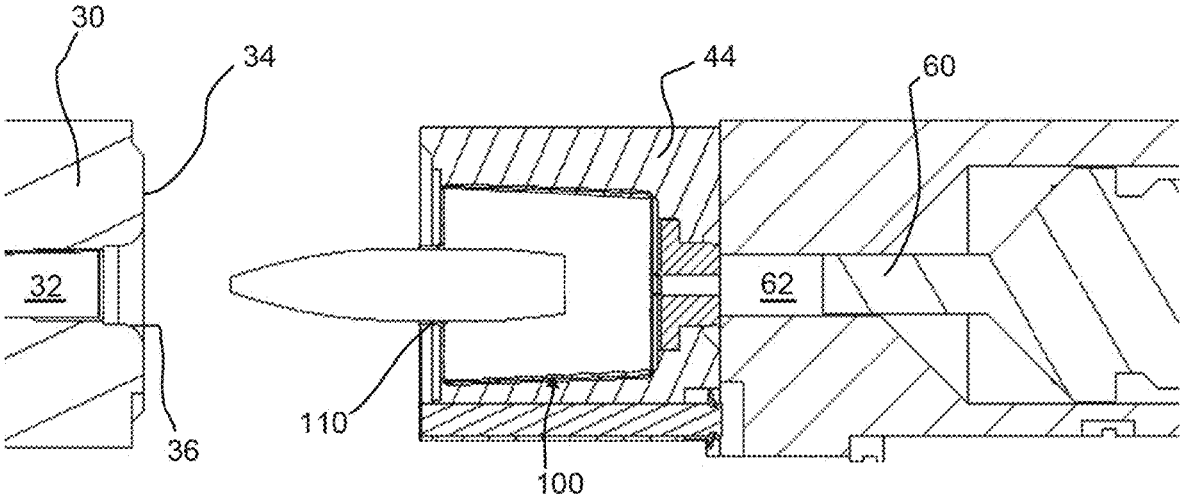
FIGS. 3A and 3B illustrate forward obturation of the presented ammunition cartridge with a rearward face of a barrel.
Figure 3B:
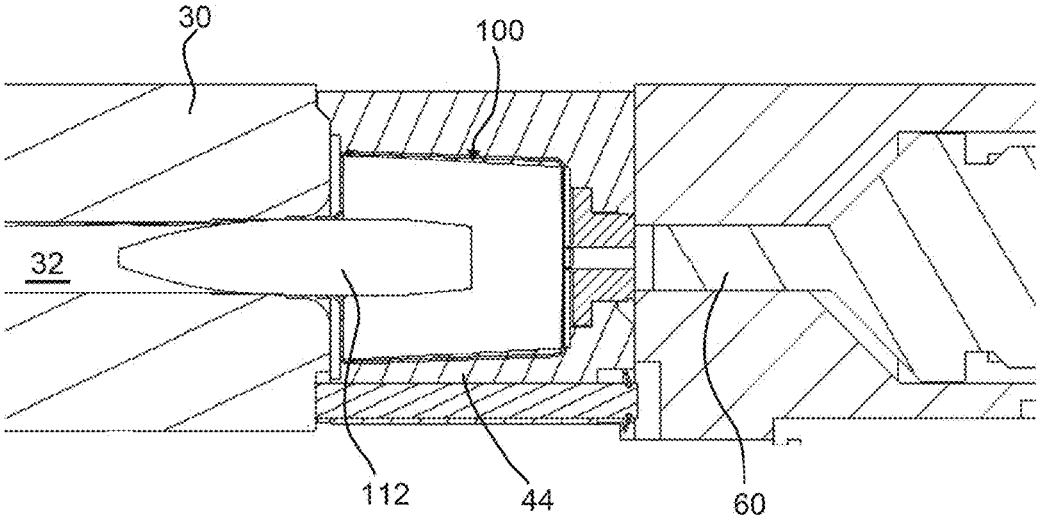

One major area of weight savings in CSR ammunition is the increased volumetric efficiency of the cartridge, which reduces the amount of brass necessary to hold a given amount of propellant. Weight savings in the CSR ammunition are also possible because the CSR is not required to obturate the chamber of the LAW. Conventionally, a bullet of an ammunition cartridge is designed to obturate the inside of a chamber of a firearm, increasing the pressure with which the bullet is fired. In contrast, the CSR ammunition 100 obturates in two ways as illustrated in FIGS. 3A and 3B. As shown in FIG. 3A, the CSR cartridge 100 is positioned in a firing chamber 44 prior to insertion of the projectile 112 (e.g., bullet) into a rearward end of a barrel 30 of a rifle. As shown in FIG. 3B, the CSR cartridge 100 is seated in the firing chamber 44 and is then advanced forward with the firing chamber 44 such that moves to a firing position with the projectile 112 is inserted into the bore 32 of the barrel 30. The shoulder or flat face 106 of the CSR cartridge obturates against a rearward face 34 of the barrel 30 of the correspondingly configured rifle. Secondly, the neck 110 of the CSR ammunition 100 obturates against a bullet seat 36 of the barrel 30. The CSR cartridge is held in this position through firing as discussed herein.

In many centerfire weapons, particularly automatic weapons, the cartridge cases have a much heavier wall near the base to prevent expansion of the case into openings between the rear end of the chamber and the bolt where the cartridge case is not fully enclosed or supported by the chamber or bolt face. The design of the firing chamber 44 of the LAW 10 fully encapsulates the rearward portion of the CSR ammunition 100 (as shown in FIGS. 3A and 3B), eliminating the need for this thick-walled section of the case, resulting in increased weight savings. As discussed herein, a divorced chamber design of the LAW system 100 compensates for the thin wall of the CSR ammunition 100 by completely enclosing the round while allowing for forward ejection of the spent cartridge. This eliminates the need for any rearward cartridge extraction feature on the CSR ammunition.

Another important weight savings for the CSR cartridge, in one embodiment, is the lack of a conventional primer. A conventional primer accounts for a not insignificant portion of the total weight of a cartridge. Although CSR cartridges could also be produced using conventional primer technology, one embodiment of the CSR ammunition is fired using diesel ignition which eliminates the need for and weight of a primer. That is, in one embodiment, CSR ammunition 100 is designed to be fired using diesel ignition, a process in which a spring driven piston compresses air—raising its temperature through adiabatic heating—and forces it into contact with propellant of the casing, resulting in ignition of the propellant and firing of the round. The weight and cost savings due to elimination of a discrete primer as an element of the ammunition are significant.

One embodiment of the diesel ignition process is illustrated in FIGS. 3A and 3B. FIG. 3A illustrates a firing piston 60 in a retracted position that is maintained while the cartridge 100 is positioned against the barrel 30. The firing piston 60 remains retracted until shortly after the cartridge is positioned (not shown). During operation, a user may pull a trigger releasing the firing piston 60 or, in a fully automatic operation, the firing piston 60 may automatically release at an appropriate time in the firing cycle. The forward end of the firing piston 60 moves forward compressing air in the piston bore 62, which passes into the rearward end of the cartridge casing igniting the propellant therein due to adiabatic heating of the compressed air.

Most conventional, commercially available propellants ignite at a temperature of 350-400° F. (single base propellants) or 320-360° F. (for double based propellants). Autoignition temperatures of any propellant of interest may be determined using Differential Scanning Calorimetry and Thermogravimetric Analysis (DSC-TGA). Assuming compression occurs over a short enough time scale to neglect heat transfer into the surrounding material, the temperature change of adiabatically compressed air can be calculated using the following formula:

$$\frac{T_2}{T_1} = \left(\frac{V_1}{V_2}\right)^{k-1}$$

Using a set compression ratio of 50:1, the temperature of adiabatically compressed air was calculated at starting points of −60° F., 70° F. and 160° F. (Table 1).

TABLE 1

Temperature of adiabatically heated air from a range of base air temperatures

| Starting Temperature $T_1$ (° F.) | Compressed Air Temperature $T_2$ (° F.) |
|---|---|
| −60 | 1450 |
| 70 | 2069 |
| 160 | 2500 |

As shown in Table 1, such a compression ratio (e.g., piston bore volume V1 before piston advancement to piston bore volume V2 after piston advancement) results in a temperature increase sufficient for propellant ignition for all expected operating conditions. Though discussed as utilizing a 50:1 ratio, higher and lower ratios are possible.

To initiate firing, the heated, compressed air must contact the propellant charge. In an embodiment, the CSR cartridge incorporates a penetrable seal allowing the compressed gas to puncture the casing 102 and ignite the propellant. Several non-limiting embodiments of an air penetrable seal on the CSR ammunition cartridge are presented.

One solution is to form a rupture disc directly into the back of the CSR casing itself. A rupture disc is formed by stamping a thinned section 116 into the brass or other material forming the rearward end 104 of the CSR casing 102. This is illustrated in FIG. 2C. In such an embodiment, one more notches 118 may radiate from the center-point of the thinned section 116. By controlling the material thickness in the thinned section and the depth of the notches, the pressure required to rupture the disc can be precisely controlled. Advantages of the rupture disc concept include the robustness and that the hermetic seal of the casing is maintained, providing the best, longest life protection for the propellant. During the diesel compression cycle, the highly pressurized air breaks the integrally formed rupture disc, providing a path for the hot air to ignite the propellant/powder.

A second approach, similar in function, is the use of a mylar disc or other thin material disk (e.g., polymer) adhered to the rear end of the cartridge. The mylar disc (not shown) covers a small pre-formed hole in the rearward end of the cartridge. During the diesel compression cycle, the highly pressurized air breaks the mylar disc, providing a path for the hot air to ignite the powder.

A third approach is to puncture the rear end 104 of the casing 102. Puncturing the rear end 104 of the casing 102 may be accomplished either when the case is first picked up by the rotating chamber, as the chambered round is pushed into the barrel, or by means of a puncture pin (not shown) that is driven by the firing piston 60 (e.g., diesel ignition piston). This provides a robust case, ease of manufacturing, and would provide a round that is remarkably safe for handling and transport.

Figure 4:
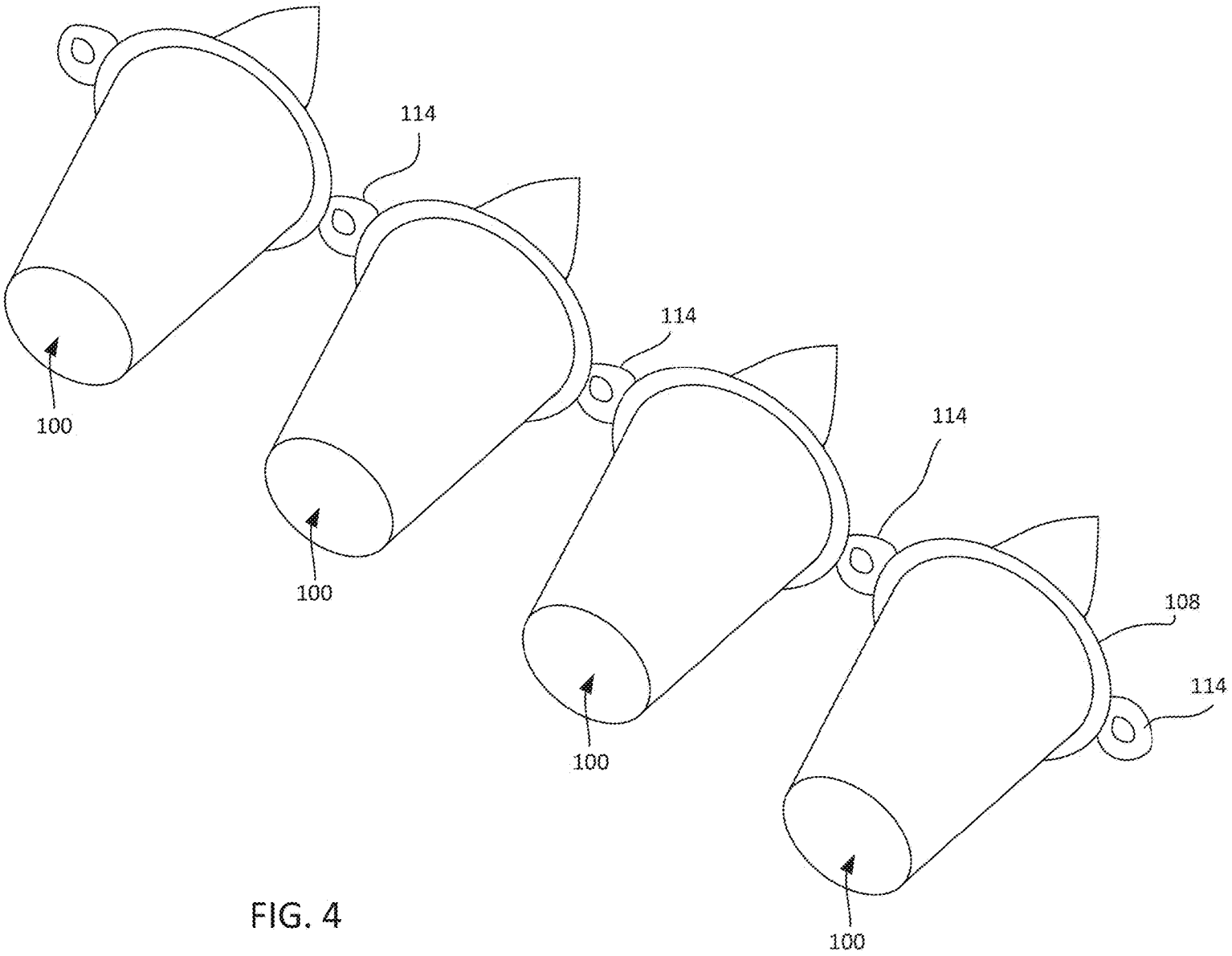
FIG. 4 illustrates a modular link or belt made of the presented ammunition cartridge.

Additional weight savings and flexibility in design is available in linked CSR compared to conventional linked ammunition as well. FIG. 4 illustrates a modular link 114 that is directly integrated into the case 102 of the CSR ammunition 100. As shown, the modular links are formed on opposing edges of the rim 108. These modular links may be press fit together to provide an ammunition belt. This design provides a significantly decreased weight, due to the lack of steel linking elements of a convention ammunition belt. Such an embodiment could be used in drums or boxes.

The greatest gain in reducing the weight of the ammunition is that the weight savings of each cartridge is multiplied by the number of rounds carried by the soldier. It is therefore one objective to reduce the weight of the CSR as much as possible. If the ammunition weight is reduced by 30%, a soldier's combat load can either be significantly reduced, or the soldier can carry nearly 40% more ammunition.

Testing has demonstrated that each brass cartridge of the M855 round removes approximately 150 joules of heat energy from the chamber of the M249 during sustained rapid firing. This accounts for a significant percentage of the energy delivered to the projectile. If a brass case is replaced with a polymer (or some other synthetic material), heat rejection could become a concern, and could have the effect of reducing the sustained rate of fire. Maintaining the use of a brass or other metal cartridge for the CSR ammunition provides a similarly high level of heat rejection. Heat control is further complemented by the multiple chamber design of the LAW, which reduces the duty cycle of each chamber by two-thirds compared to a conventional automatic weapon due to the reduced duty cycle of each chamber.

In an embodiment, a 6.8 mm caliber CSR cartridge would achieve a 3200-fps muzzle velocity with a 136-gr bullet, which approximates the performance of a similar conventional round, the Winchester 0.270. Using this projectile, the weight of propellant of the prototype CSR is calculated to be 17.23 grams. The length of the prototype CSR was 1.86 inches. Compared to a Hornady Winchester 0.270 140 gr SST (which has comparable muzzle energy in a conventional ammunition package), was a 30% weight reduction and 45% length reduction. This allows for significant reduction of weapon length. The receiver travel required to load and fire the CSR is less than half of that required for a weapon firing conventional ammunition. This also results in a significant weight savings.

Due to the simple design and conventional materials of the CSR ammunition, the performance of this ammunition is as flexible as any conventional round. Different propellant loads can be applied to tailor the performance. Alternatively, different types of propellants can be developed to further increase muzzle velocity as necessary. While discussed primarily as utilizing a brass case for thermal benefits, among other reasons, it will be appreciated that the design of the case is not limited to brass. As the technical maturity of polymer cases increases, it is very possible that additional weight savings could be achieved by using a polymer case.

Lightweight Automatic Weapon

The LAW 10 illustrated in FIGS. 1A and 1B is designed for use in conjunction with ammunition similar to the CSR ammunition described above. A primary weight reducing feature of the LAW is the significantly reduced action/receiver length enabled by the short length of the CSR ammunition and a divorced chamber concept. The action of the LAW is significantly shorter than that of the M249 SAW (or any other conventional machine gun) due to a combination of the shorter ammunition and the divorced chamber. This reduced action length results in a much shorter overall length for the receiver. Additionally, in one embodiment, weight savings (when compared to the M249) are realized by using a magazine, which eliminates the belt feed components from the receiver. However, it will be expressly understood that various attributes of the LAW may be applicable to differently configured ammunition including belt fed arrangements and that the present disclosure in relation to use of the CSR ammunition is presented by way of example and not by way of limitation.

Figure 5A:
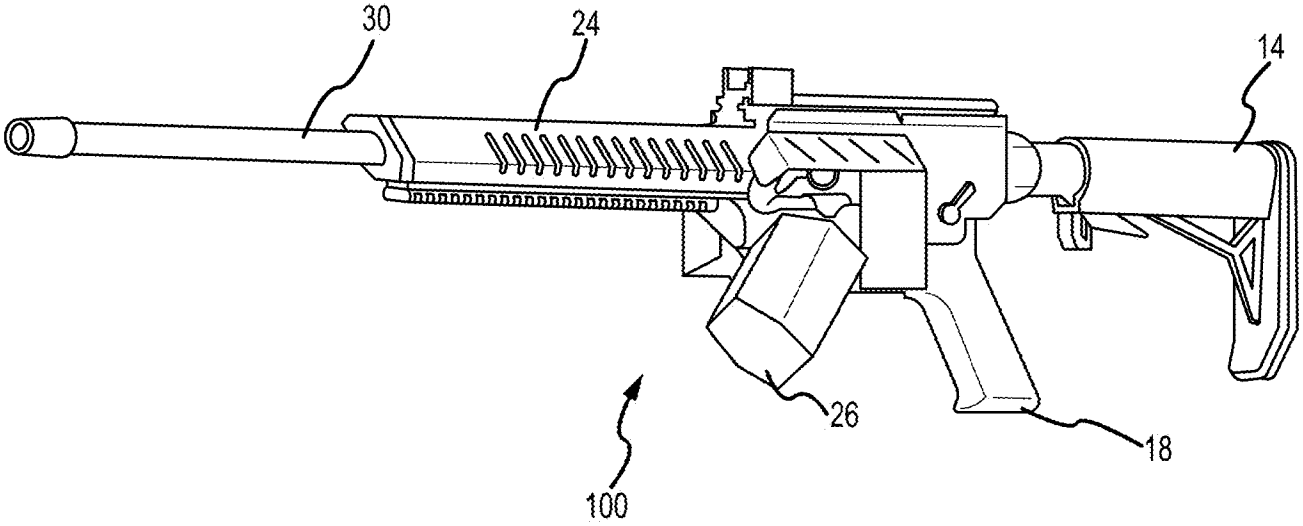
FIG. 5A illustrates a perspective view of one embodiment of the automatic or semiautomatic rifle.
Figure 5B:
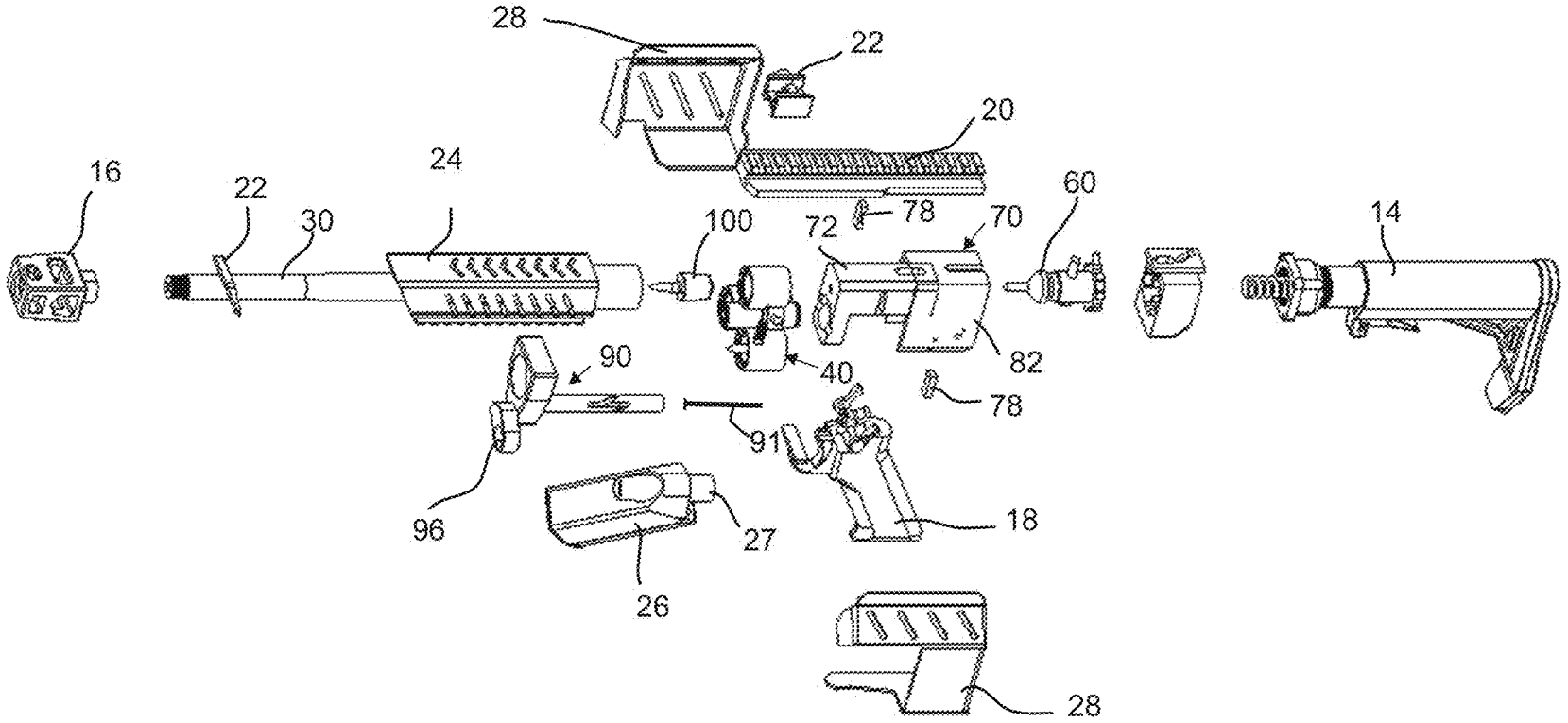
FIG. 5B illustrates an exploded view of the automatic or semiautomatic rifle of FIG. 5A.

FIGS. 5A and 5A illustrate perspective and exploded perspective views of the LAW 10. As shown in FIGS. 5A and 5B, the LAW 10 includes a number of conventional components that are well understood by those skilled in the art. For instance, the LAW may incorporate a bipod 12, a collapsible or sliding buttstock 14, flash suppressor 16, pistol grip and trigger assembly 18, top rail 20, forward and rearward sights 22, barrel shroud/backbone 24, a magazine 26 (though the magazine may be modified to hold the CSR ammunition) and/or various housings/shrouds 28, which in the present embodiment surround a rotating or carriage chamber. No further discussion is provided regarding these generally conventional elements. The largely conventional exterior allows for easy integration with existing enablers, suppressors and other equipment. Several additional attributes provide the unique operation of the LAW 10. These attributes include, include the barrel 30 having the rear obturating face, the rotating chamber assembly or chamber assembly 40, the diesel ignition piston system 60, and the locking bolt assembly 70.

Figure 6A:
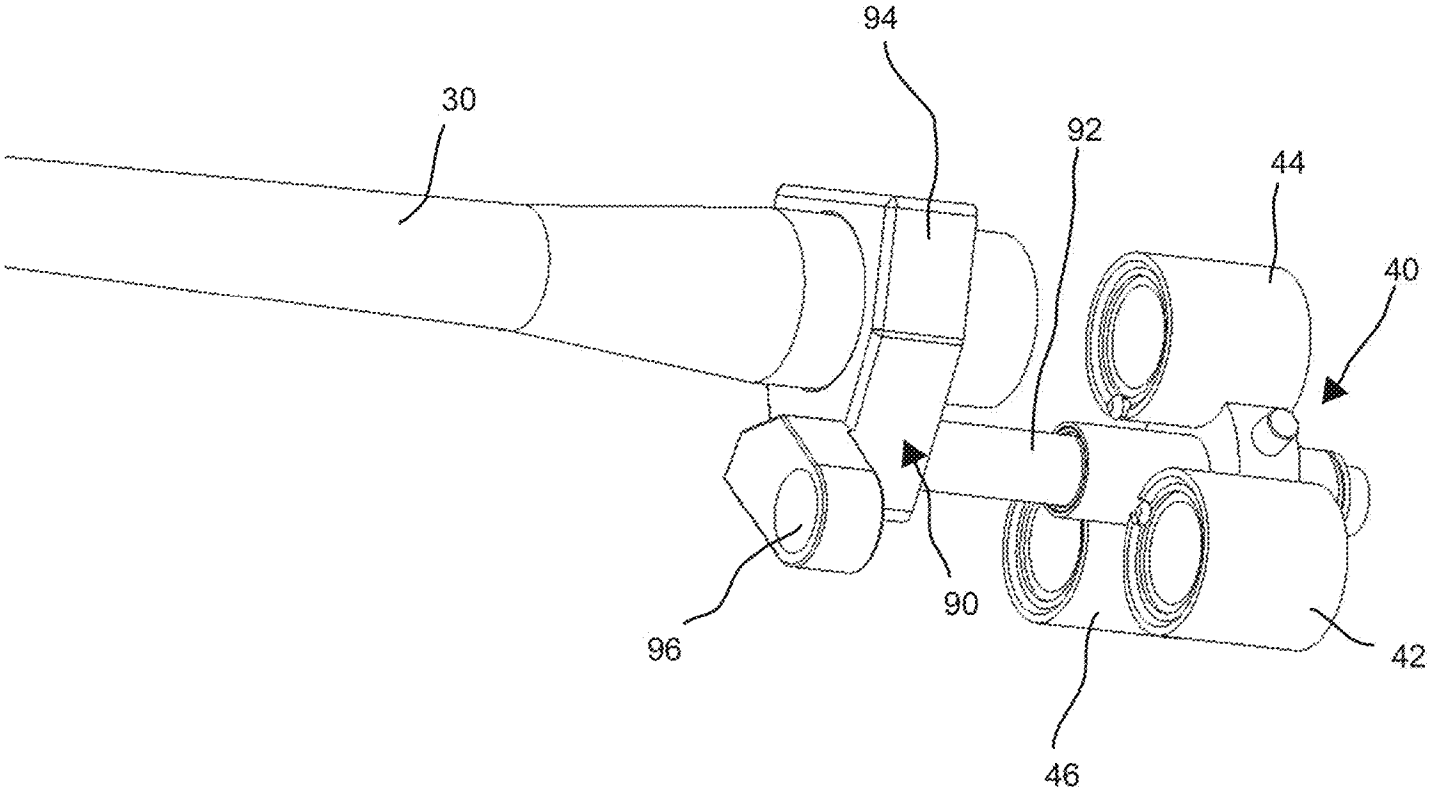
FIGS. 6A and 6B illustrate a divorced chamber assembly of the rifle relative to a barrel of the rifle.
Figure 6B:
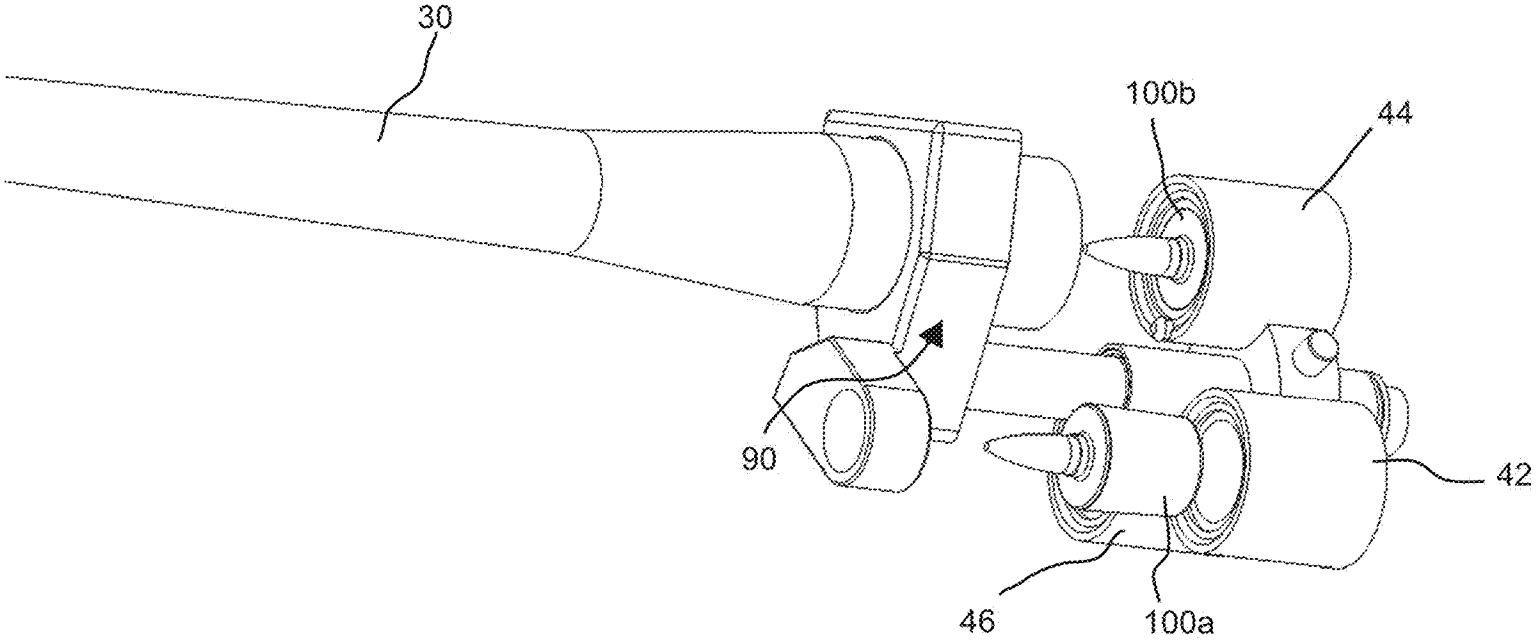

To illustrate the divorced chamber concept, FIGS. 6A and 6B illustrate the barrel 30, the chamber assembly 40 and a guide shaft assembly 90 that connects the barrel 30 and chamber assembly 40 (i.e., while permitting movement between these components). The LAW 10, in the illustrated embodiment, is a gas driven, open bolt weapon/rifle having a rotating chamber carriage 40 made of three chambers 42, 44 and 46. During a firing cycle, each chamber can be labeled based on the function it is performing. The "Ready Chamber" 42 picks up the next round to be fired, or the "Ready Round" 100*a*, the "Firing Chamber" 44 engages the barrel and seats the "Firing Round" 100*b*, while the "Ejecting Chamber" 46 engages an ejection ram to eject a spent case 100*c* of the last round fired. In a fully automatic weapon configuration, all three of these actions are happening simultaneously. In any configuration, after the cartridge/round is fired, the chamber assembly rotates 120° to move the rounds through each position. By way of example, the ready chamber rotates to the firing position and becomes the firing chamber after firing the previous round. Once rotated to the firing position, the forward end 45 of the current firing chamber 44 moves from a retracted position (e.g., shown in FIGS. 3A, 6A and 6B) to an extended forward position juxtaposed with the rearward face 34 of the barrel 30 (e.g., see FIG. 3B) to load a cartridge into the barrel 30 for firing. As noted above, the forward portion of the CSR ammunition obturates against the rearward face 34 of the barrel.

As shown, the chamber assembly 40 and the chambers 42, 44 and 46 are physically separated (e.g., divorced) from the barrel during the firing cycle to permit rotation, retraction and advancement. To allow for divorcing the chamber from the barrel, the cartridges 100 are loaded into the ready chamber 42 from the front end of the chamber (e.g., toward the forward end or muzzle of the rifle) as opposed to from the rear of the chamber as in a conventional rifle where the barrel and firing chamber are in fixed configuration. There are several advantages of the divorced, rotating chamber concept. There is little heat transfer from the barrel to the chamber during the firing cycle because the chambers are divorced from the barrel. Additional convective cooling of the chambers is possible as the divorced chambers will rotate away from the barrel and move through the surrounding air. Further, the multiple chambers also reduce the duty cycle for each chamber (i.e., firing only one in three rounds fired by the weapon).

Figure 7:
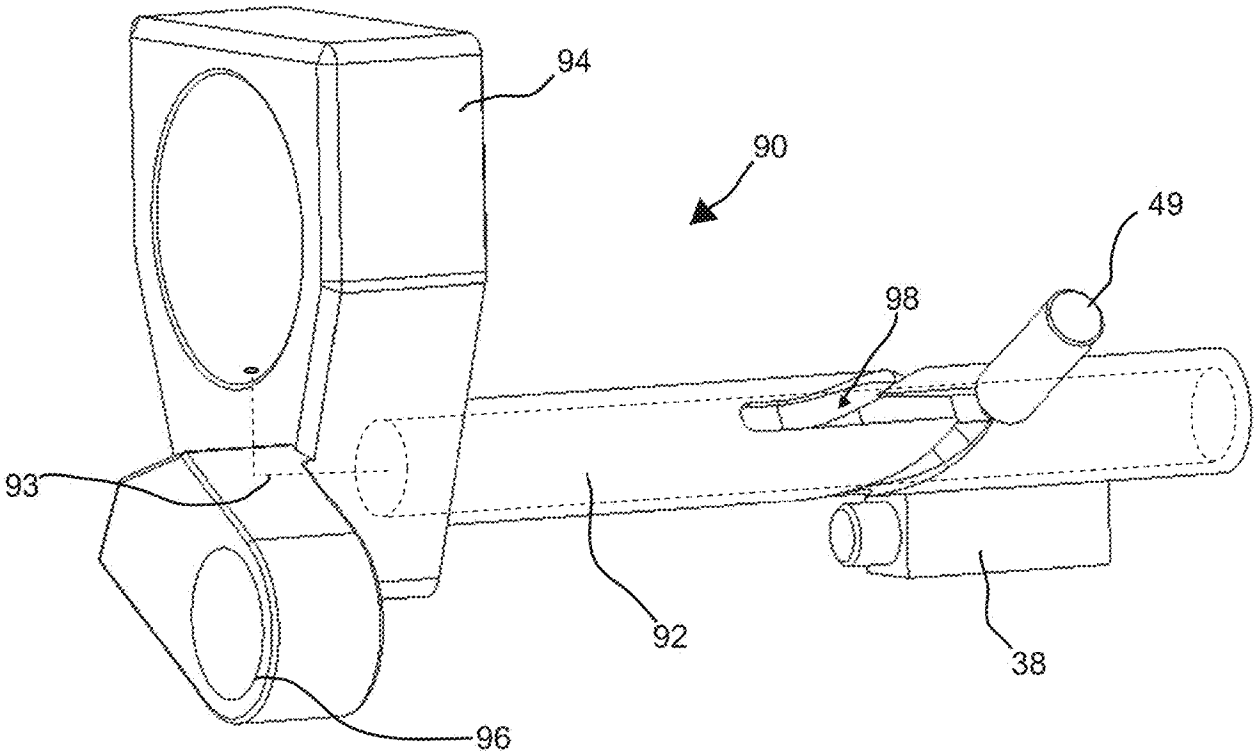
FIG. 7 illustrates a guide shaft assembly.
Figure 8A:
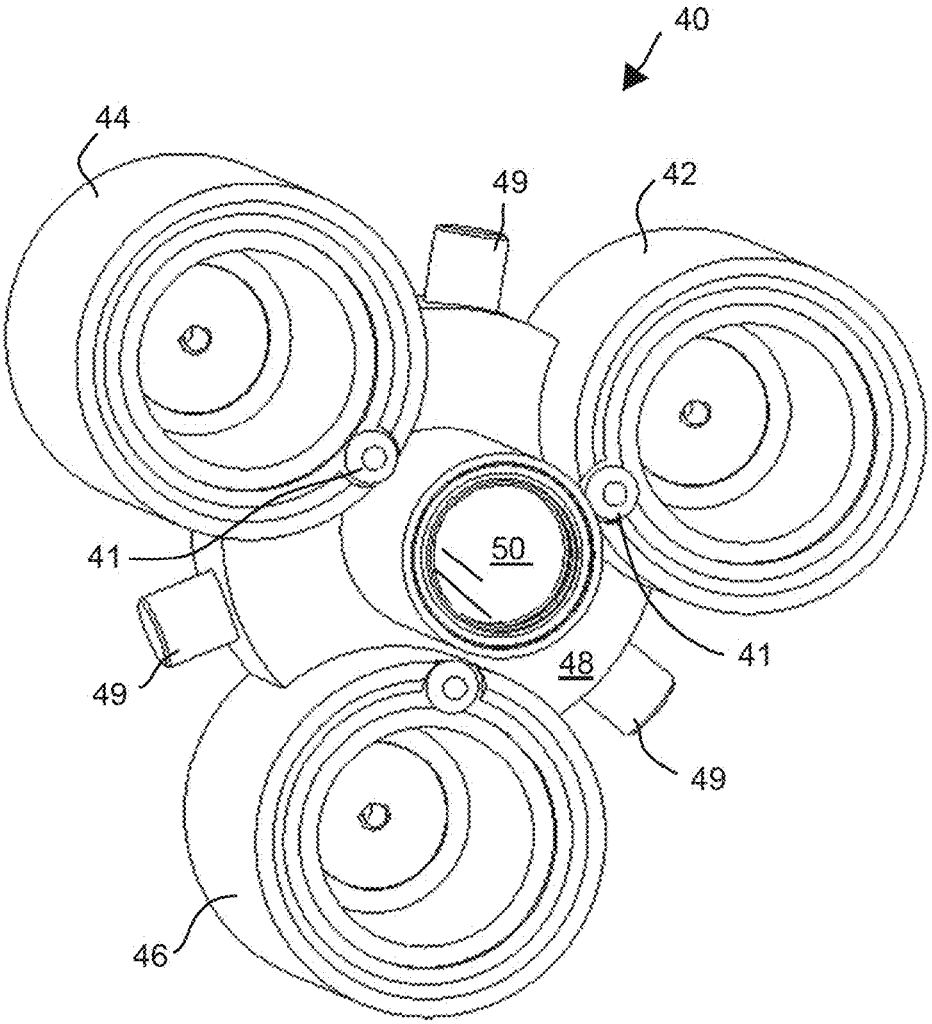
FIG. 8A illustrates a perspective view of the chamber assembly of the rifle.

As shown, the chamber assembly 40 rotates about a shaft 92 of the guide shaft assembly 90 as well as sliding between the advanced and retracted positions. FIG. 7 illustrates the guide shaft assembly 90. As shown, the guide shaft assembly 90 includes the guide shaft 92 which passes through a central aperture of the carriage assembly. In addition, the guide shaft assembly includes a barrel receiver 94 having aperture sized to receive the barrel. In the illustrated embodiment, the guide shaft assembly 90 further includes a magazine receiving lug 96 that is adapted to receive a corresponding lug 27 on the magazine. See e.g., FIG. 5B. To permit the rotation of the chamber assembly, the shaft 92 includes a plurality of chamber guide grooves 98. These grooves include three axial grooves (e.g., spaced 120° about the shaft) that permit the advancement of the chamber carriage from the rearward position to the forward or firing position (i.e., where the cartridge in the firing chamber obturates with the barrel) and three helical grooves that each extend between the forward end of an axial groove and the rearward end of an adjacent axial groove. These grooves receive three plungers 49 (only one shown) that extend through a central hub 48 of the chamber assembly 40 as illustrated in FIG. 8A. These plungers guide the chamber assembly about the shaft during operation.

Of further note, the interior of the shaft 92 may be hollow as illustrated by dashed lines in FIG. 7. In this regard, the shaft may define a gas ejection tube through which ignition gases from the propellant are routed to a piston/actuation rod 91, which extends through at least a portion of the hollow interior of the shaft 92. See FIG. 5B. Upon receipt of expansive gases from the barrel, the piston/actuation rod 91 is forced rearward. Thus, a rearward end of the actuation rod engages an interior of the hub (e.g., closed end, or other structure within the interior of the hub) forcing the chamber assembly rearward. That is, the actuation rod 91 retracts the chamber assembly 40 after firing each round through the barrel. In an embodiment, a port 93 extends from the hollow interior of the shaft through the barrel receiver 94 and the barrel to capture ignition gases once a round is fired. In further embodiments, an additional gas ejection tube may enter the shaft from its forward end such that ignition gases may be captured from a port further down the barrel. Also shown in FIG. 7 is an ejector 38, which is not a part of the guide shaft assembly 90. This ejector 38 is supported by the rifle and engages a rearward end of the ejector chamber as that chamber move from the firing position to the ejecting position.

FIG. 8A illustrates the chamber carriage assembly 40. As previously noted, the chamber carriage 40 includes the ready chamber 42 firing chamber 44 and ejector chamber 46. Each of the chambers is attached to the central hub 48. In an embodiment, each chamber is attached to the central hub 40 via a pin 41. In this regard, the chambers are removable from the central hub 40. Such removable attachment may allow for replacement of the chambers to, for example replace worn chambers and/or change calibers of the rifle, which may also require exchanging of the barrel. However, it will be appreciated that the chambers and the central hub may be integrally formed. As shown, the central hub has a central journal 50 that is sized to receive the shaft of the guide shaft assembly. The central journal 50 may include various washers, bearings etc. The plungers 49 extend through the central hub to engage the grooves in the shaft.

Figure 8B:
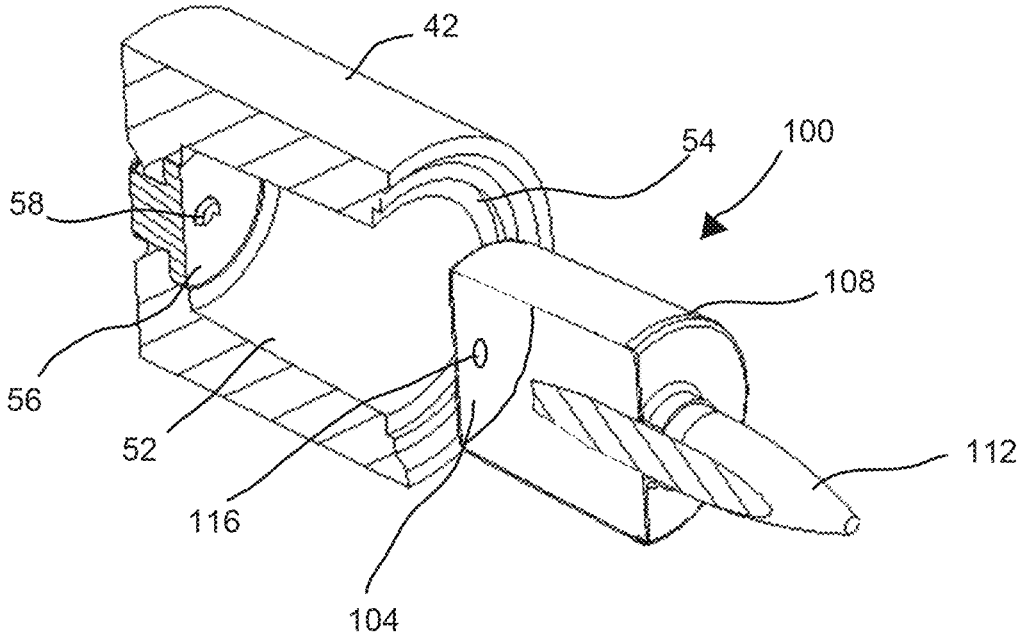
FIG. 8B illustrates a partial cross-sectional view of one chamber of the chamber assembly.

FIG. 8B illustrates a partial cross-sectional view of the ready chamber 42 positioned to receive a cartridge 100. Though discussed in relation to the ready chamber, it will be appreciated that the following discussion is applicable to each of the three chambers, which are typically identical. As shown, the chamber 42 is a generally cylindrical cup-shaped element having an open forward end sized to receive a rearward end of the previously described cartridge 100. More specifically, the chamber 42 includes an interior sidewall 52 that is tapered to match the tapered exterior sidewall of the cartridge 100. In addition, a forward end of the chamber 42 has an annular recessed landing 54 that is sized to engage the rim 108 of the cartridge 100. Accordingly, when the chamber 42 (e.g., ready chamber) advances forward, the cartridge 100 is received within the interior of the chamber 42 until the rim 108 seats on the annular landing 54. At this time the rearward end 104 of the cartridge 100 is seated at or near the bottom of the chamber 42. In the presented embodiment, the bottom of the chamber 42 includes an ejector button 56 having a central aperture 58, which permits diesel ignition gases to penetrate the rearward end of the cartridge 100. The ejector button 54 is configured to move slightly (e.g., forward and back along a central axis of the chamber) to permit the ejection of the cartridge 105 after the projectile 112 is fired. More particularly, the ejector button 54 engages the ejector 38 (see FIG. 7) when the chamber retracts and rotates from the firing position to the ejecting position. This results in the ejector button 56 moving forward slightly to partially dislodge the spent cartridge. The spent cartridge then falls forward from the chamber.

Figure 9A:
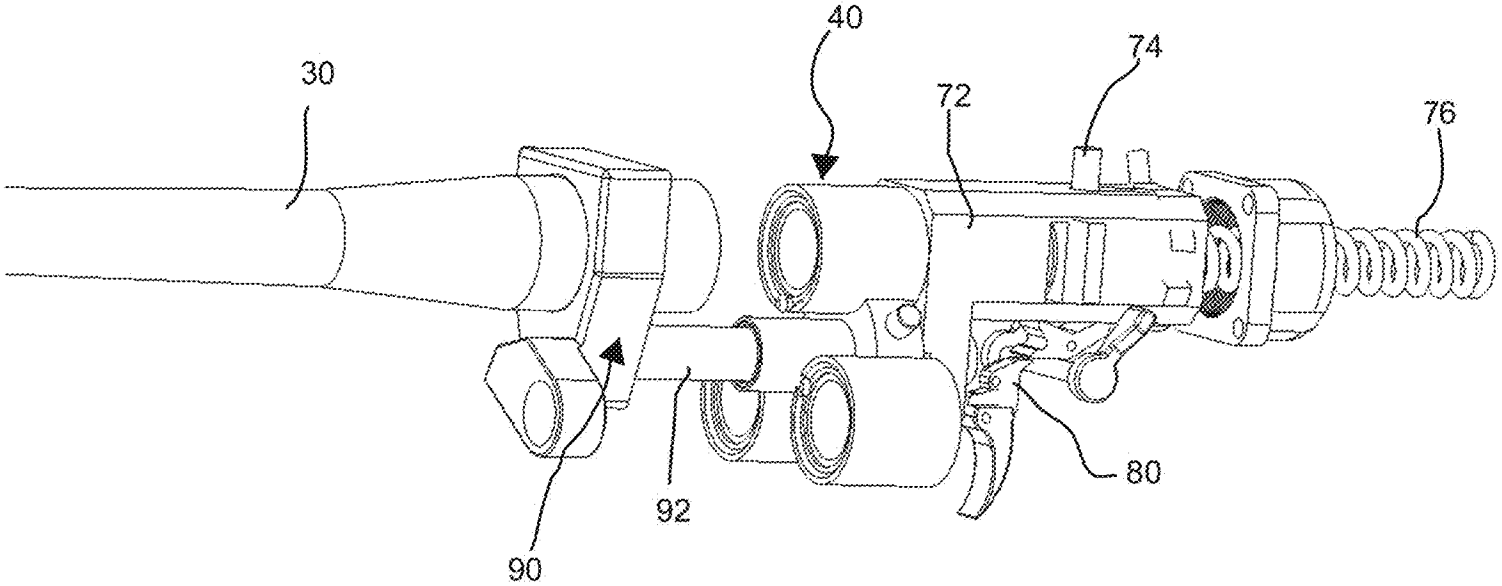
FIGS. 9A and 9B illustrate additional internal components of the rifle.
Figure 9B:
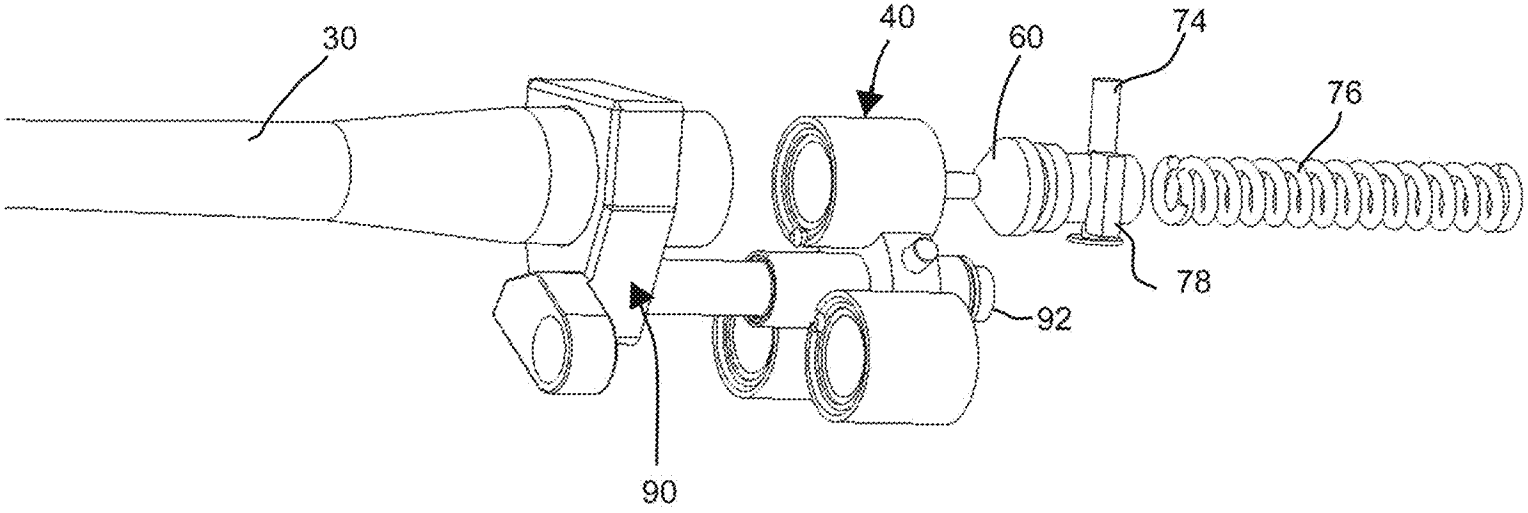

FIGS. 9A and 9B illustrate further internal components of the LAW. As variously shown in FIGS. 9A and 9B, the rearward end of the shaft 92 of the guide shaft assembly connects to a slide breach 72, which houses the diesel ignition piston 60 (or other firing piston) while allowing the piston to move forward and backward. A forward end of the slide breech includes the piston bore 62 (see FIGS. 3A and 3B). This forward end of the slide breach remains in a fixed position relative to the rotating chamber 40 such that the piston bore remains disposed against the rearward end of the firing chamber. A trunnion 82 (see FIG. 5B) is disposed over the slide breech 72 to mount additional components (e.g., buttstock, hand grip, etc.) to the weapon. The rearward end of the piston 60 engages a firing spring 76 housed in the buttstock assembly. The spring provides the energy necessary for the piston 60 to compress the air utilized for ignition as well as move the chamber assembly from the retracted position to the firing position. A charge pin 74 extends through an elongated aperture (not shown) in the slide breech and through the piston 60 for manually charging the weapon. Two lugs (one shown) 78 engage between the piston 60, the slide breech 72 and outer trunnion 82 to lock the piston in place and release the piston when the trigger assembly 80 is released by the trigger (not shown). For clarity, throughout the remainder of this document, the term "bolt" will refer to the bolt group, comprised of the chamber assembly 40, slide breech 72, and diesel ignition piston 60. Further, the terms "bolt" and "bolt group" will be used interchangeably.

As an open bolt automatic weapon, if the trigger is released when there is still ammunition in the magazine the bolt will be locked in the open position, with rounds in both the ready chamber and the firing chamber. If the magazine is expended while the trigger is still depressed the bolt will lock in the forward position, requiring the weapon to be reloaded and charged before resuming firing. As with a conventional weapon, if the firing round fails to fire when seated in the barrel, the charging handle 84 will need to be pulled to clear the dud round and advance the ready round into the firing round position. Squeezing the trigger will then release the bolt and resume firing.

Figure 10A:
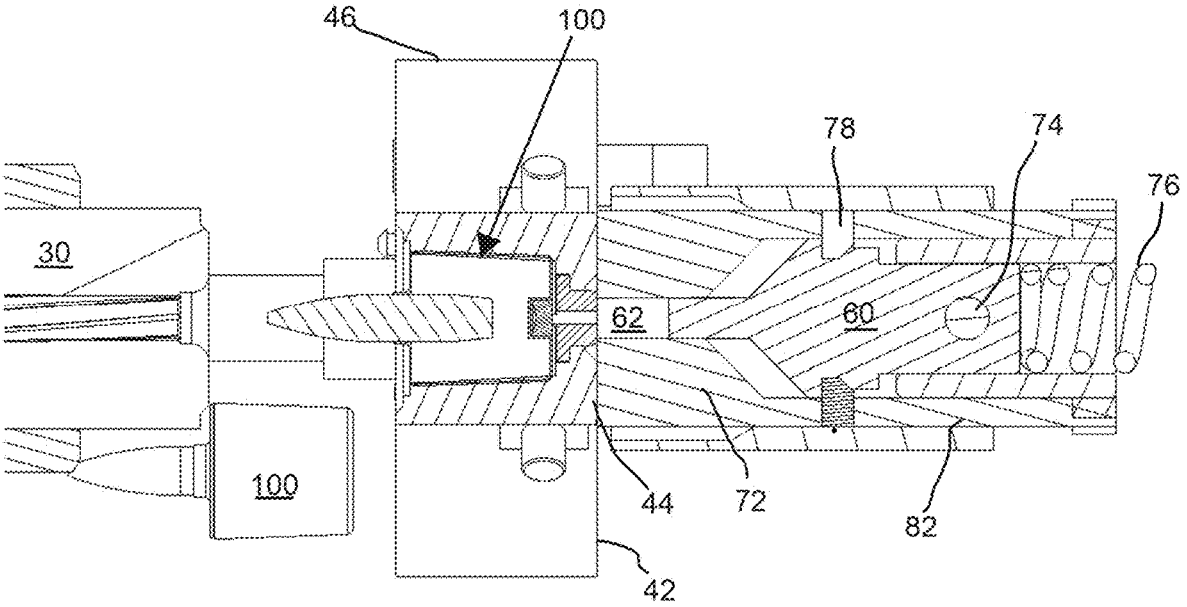
FIGS. 10A-10E illustrate cross-sectional views of a firing sequence of the rifle.
Figure 10B:
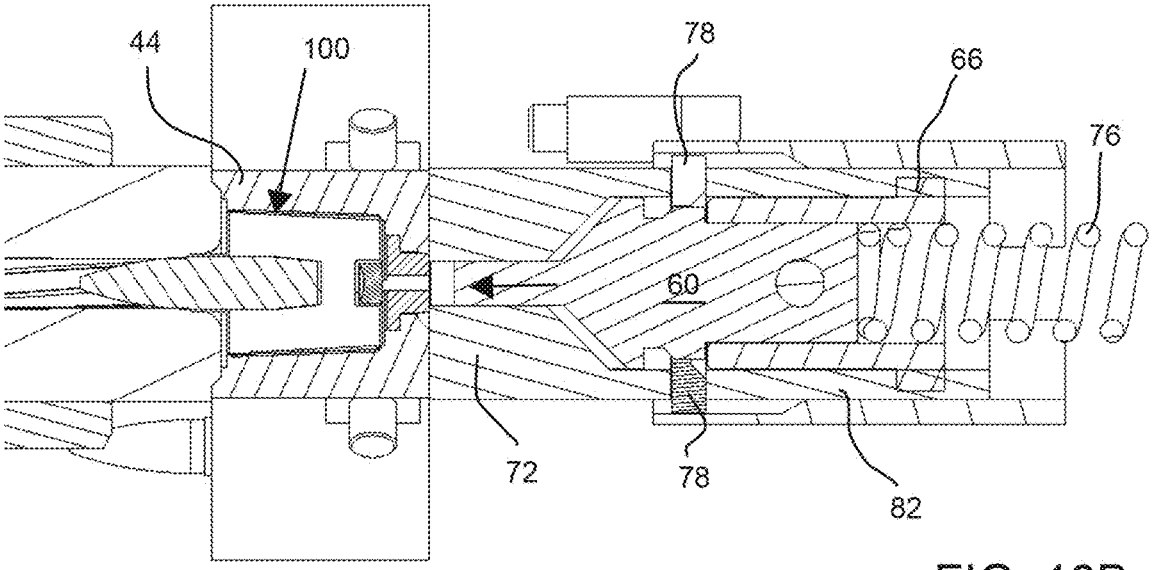

FIG. 10A illustrates a top-down section view of LAW with unlocked breech 72, one spent case in the ejection chamber, one round 100 in the firing chamber 44, and one round 100 about to be picked up by the ready chamber 42 in what may be referred to as a loaded and charged configuration. Once loaded and charged where the spring 76 is compressed (FIG. 10A) the trigger pull releases the bolt group which then begins to move forward (FIG. 10B). The diesel ignition piston 60, contained within the slide breech 72, also begins to move forward at this time, as it locked to the slide breech 72 with the ignition piston locking lugs 78.

Figure 10C:
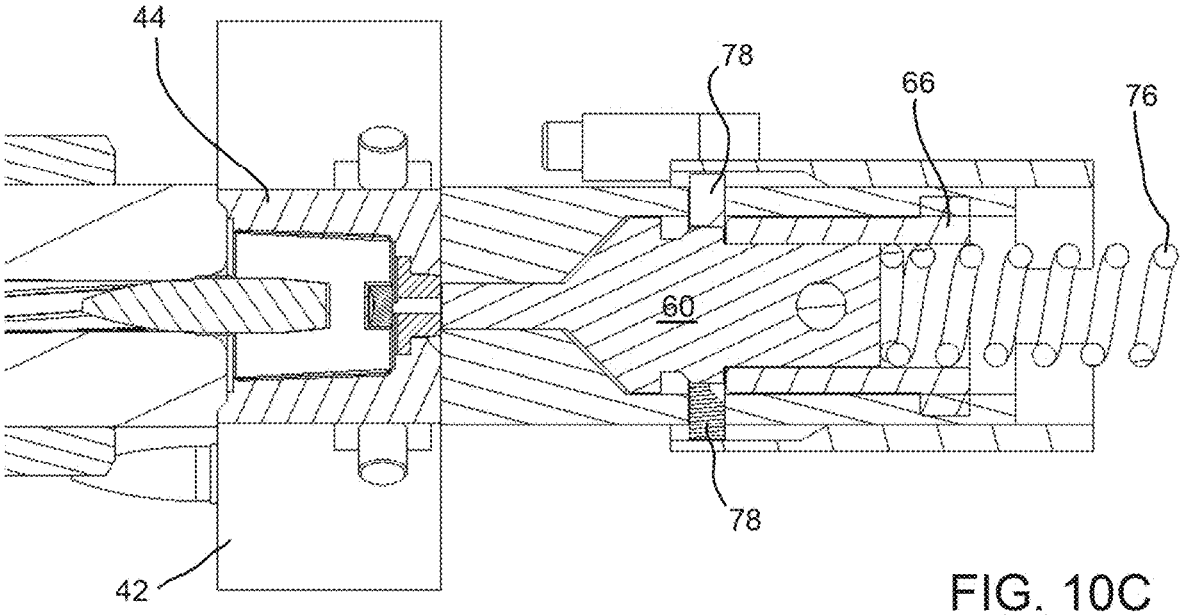

As the bolt group moves forward and the firing chamber 44 contacts the rearward barrel face, the firing round 100 becomes fully seated in the bullet seat of the barrel 30 and the round is ready to fire. At this point in the firing cycle is when a conventional round in a conventional weapon would be considered "chambered." The total travel distance of the chamber assembly is just over half the length of the CSR round 100. At this position, the piston lugs 78 retract, releasing the diesel ignition piston 60 (FIG. 10B). The diesel ignition piston 60 moves forward (driven by the bolt spring) and compresses the air within the ignition column/piston bore 62. This causes the temperature of the air to increase. Because of the speed at which the air compression occurs, the air will behave as a viscous fluid, eliminating the need for seals or compression rings on the piston 60. At the end of the stroke, a lock sleeve 66 of the piston is rotated into place, which locks the piston, breech and chamber assembly together as the cartridge is fired (FIG. 10C). For a primer ignited CSR, the Diesel Ignition Piston would be replaced with a traditional firing pin. The forward motion of the chamber assembly 40 also simultaneously loads the cartridge from the magazine into the ready chamber 42 (FIG. 10C).

Figure 10D:
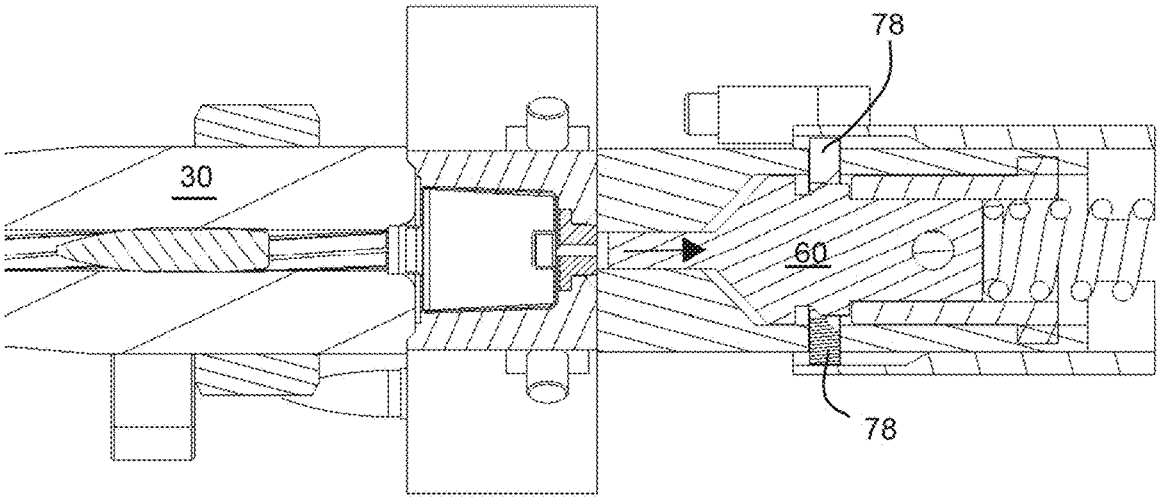
Figure 10E:
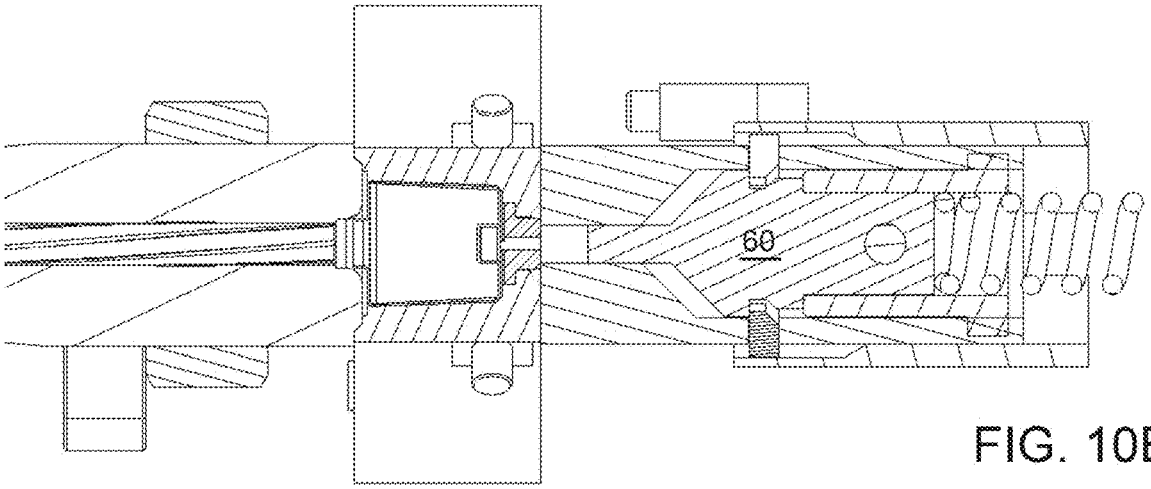

The ignition gases from the propellant are routed through a gas tube, piston/actuation rod. This energy is used to rotate the piston, unlock the locking sleeve and begin retraction of the piston (FIG. 10D). When the piston 60 has retracted far enough, the piston lugs 78 engage with the slide breech 72 and begin retraction of the chamber 40 and breech 72, (FIG. 10E).

Figure 10F:
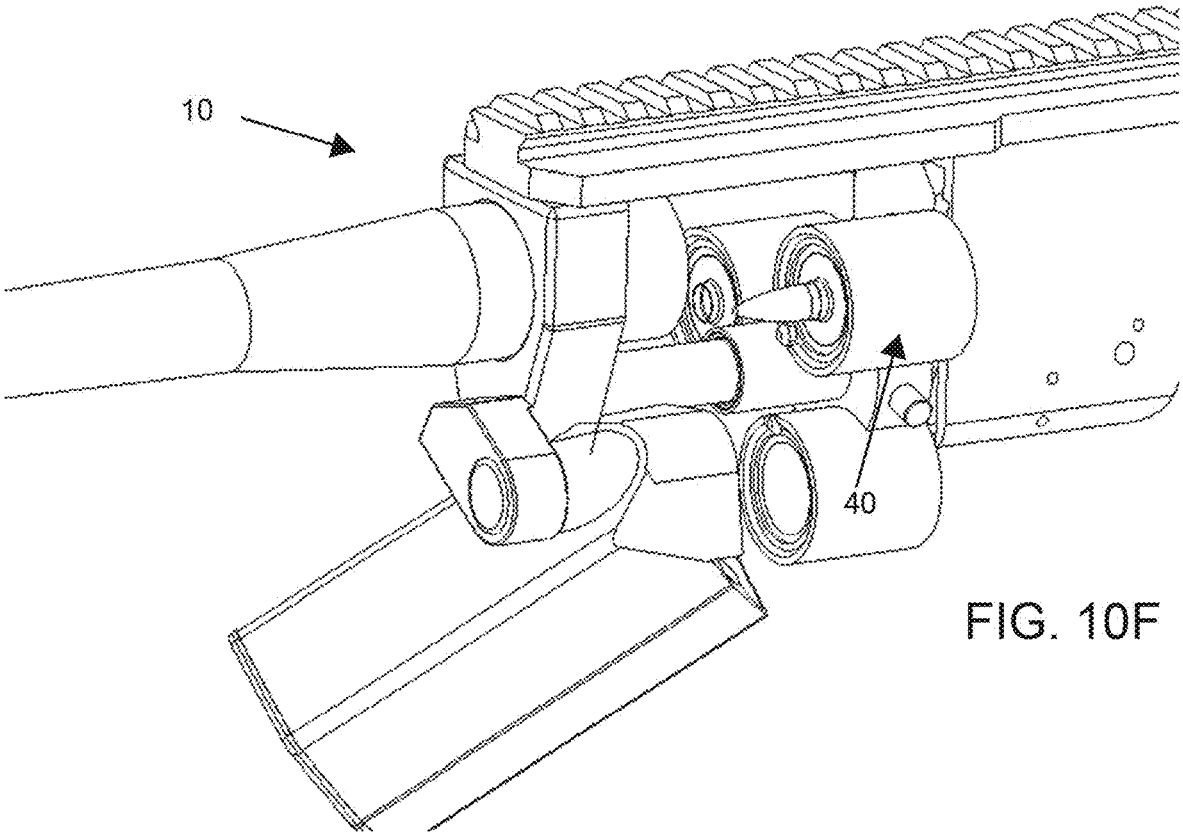
FIG. 10F illustrates a perspective view of the rotation of the chamber assembly of the rifle.

As the chamber assembly retracts, it also rotates 120° about the Guide Shaft (FIG. 10F). This rotation is the action that simultaneously moves the spent case into position to be ejected, moves the ready round into the firing round position, and moves the just emptied chamber into the ready chamber position to pick up the next round when chamber assembly moves forward. At the end of this rotation, the spent case is ejected from its chamber, now in the ejection chamber position, and the previously loaded ready round has been rotated up into the firing round position, and the process is ready to repeat. If the trigger is released, the chamber assembly and slide breech are locked in the rearward, or charged, position at the end of this retraction. If the trigger is held down, the cycle repeats from the beginning.

As noted, the total travel distance of the chamber assembly is just over half the length of the CSR round 100, which allows the action to be shorter than that of a conventional rifle. The shortened length of the action not only reduces the weight of the receiver by shortening the required components, it also allows for weight reduction by reducing the reciprocating forces. The reduced length of travel means that, at a given rate of fire, the ignition piston, chamber and locking slide breech can move at a lower velocity than an equivalent mass within a traditional receiver with an equivalent rate of fire. This lower velocity translates to lower inertia and lower reciprocating forces, allowing the weight of the receiver wall to decrease. The lowered inertial forces may also result in less wear in the weapon system.

Loading the LAW with a new magazine is a simple process, very similar to loading conventional magazine fed automatic weapons. As in conventional weapons, the magazine may be fitted into a magazine well. A dust cover may function as the catch for the magazine. Because of the unique multiple chamber design, the charging handle will be pulled twice when a new magazine is loaded to prepare the weapon for firing—once to load the ready round into the ready chamber, and once to advance the ready round into the firing round position.

Alternative Designs

Additional modifications of the proposed design are envisioned and within the scope of the present disclosure. For instance, to further reduce the length of the LAW a bullpup-style receiver may be utilized. A bullpup weapon refers to a weapon in which the action and magazine are located behind the trigger, allowing for a shorter weapon at a given barrel length. Another potential design modification is the inclusion of a traditional firing pin. The LAW design can also be easily modified to fire additional calibers. An advantage of the proprietary multi-chamber design is that it enables the receiver of the LAW to be essentially caliber independent. By switching out the chamber and barrel, it is possible for the LAW to fire a wide range of ammunition while maintaining the essential function of the receiver. This modularity is also useful for repair and replacement of individual components. It is also important to note that the CSR ammunition and divorced chamber concept do not limit the feed type or the action type. A single chambered, bolt action weapon could be easily adapted from the existing LAW concept. This flexibility is particularly desirable when considering the expandability of the CSR/LAW system for use in carbine or sniper applications. Because of the conventional layout and configuration of the LAW, additional enablers can easily be accommodated. The forward Hand Grip area of can accommodate Picatinny rails on top, bottom, and both sides.

As currently designed, and constructed entirely in steel, the LAW system weight, including a notional bipod and suppressor, is at just under 15 pounds. The use of conventional materials for this initial design allows significant room for weight reduction through both material substitution and design modifications. As currently designed (with a 20-inch barrel) the LAW is less than 38 inches. Optimization of the receiver and butt stock design could further reduce this length by as much as 6 inches. Other approaches include shortening of the barrel or use of a bullpup style action. As currently designed, the LAW has a burst rate of fire of 750 rounds per minute (RPM). However, it is anticipated that the burst RPM could be considerably higher if desired.

The foregoing description has been presented for purposes of illustration and description. Furthermore, the description is not intended to limit the inventions and/or aspects of the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the application(s) or use(s) of the presented inventions. It is intended that the appended claims be construed to include alternative embodiments to the extent permitted by the prior art.

What is claimed:

1. An ammunition cartridge comprising:
- a generally cylindrical cup-shaped case having a hollow interior configured to hold a propellant charge, the cup-shaped case including:
  - a closed rearward end having a rearward diameter;
  - an open top end having a forward diameter, wherein the forward diameter is greater than the rearward diameter; and
  - a sidewall extending between a periphery of the closed rearward end and a periphery of the open top end, wherein an outside surface of the sidewall tapers from the rearward diameter to the forward diameter along a length of the hollow interior of the cup-shaped case; and
- a top plate attached about a periphery of the top end of the cup-shaped case, wherein the top plate extends over an open end of the cup-shaped case, the top plate further having a raised annular neck defining an aperture aligned with a centerline axis of the cup-shaped case.

2. The cartridge of claim 1, further comprising:
- a projectile disposed within the aperture defined by the raised annular neck of the top plate, wherein at least a portion of the projection extends beyond an upper surface of the top plate.

3. The cartridge of claim 2, further comprising:
- propellant disposed within the hollow interior of the cup-shaped case.

4. The cartridge of claim 1, wherein the sidewall is disposed at an angle to the centerline axis of the cup-shaped case.

5. The cartridge of claim 1, further comprising:
- a rim extending outward from a connection between the top plate and the open top end of the cup-shaped case about a periphery of the cartridge.

6. The cartridge of claim 5, further comprising first and second links attached to the rim at opposing locations about the rim.

7. The cartridge of claim 1, further comprising:
- a thinned section formed into the rearward end of the cup-shaped case, the thinned section having a thickness that is less than an average thickness of the rearward end of the cup-shaped case.

8. The cartridge of claim 7, further comprising:
- one or more notches extending outwardly form the thinned section, wherein the notches are formed into the rearward end of the cup-shaped case.

9. The cartridge of claim 7, wherein the thinned section is aligned with the centerline axis of the cup-shaped case.

10. The cartridge of claim 1, wherein the rearward end further comprises:
- an aperture aligned with the centerline axis of the cup-shaped case; and
- a rupture disk covering the aperture.

11. The cartridge of claim 1, further comprising:
- a primer disposed in an aperture in the rearward end of the cup-shaped case.

12. The cartridge of claim 1, wherein the cup-shaped case and the top plate are integrally formed.

13. The cartridge of claim 1, wherein at least a portion of a top surface of the top plate is configured to obturate against a rifle barrel.

14. The cartridge of claim 1, wherein the raised annular neck is configured to obturate against a bullet seat of a rifle barrel.

15. An ammunition cartridge comprising:
- a generally cylindrical cup-shaped case having:
  - a closed rearward end having a rearward diameter, the closed rearward end having an aperture aligned with the centerline axis of the cup-shaped case;
  - an open top end having a forward diameter, wherein the forward diameter is greater than the rearward diameter; and
  - a sidewall extending between a periphery of the closed rearward end and the open top end;
- a top plate attached about a periphery of the top end of the cup-shaped case, wherein the top plate extends over an open end of the cup-shaped case, the top plate further having a raised annular neck defining an aperture aligned with a centerline axis of the cup-shaped case; and
- a rupture disk covering the aperture in the closed rearward end of the cup-shaped case.

16. The cartridge of claim 15, further comprising:
- a projectile disposed within the aperture defined by the raised annular neck of the top plate; and
- propellant disposed within an interior of the cup-shaped case.

17. An ammunition cartridge comprising:
- a generally cylindrical cup-shaped case having:
  - a closed rearward end having a rearward diameter;
  - an open top end having a forward diameter, wherein the forward diameter is greater than the rearward diameter; and
  - a sidewall extending between a periphery of the closed rearward end and the open top end;
- a top plate attached about a periphery of the top end of the cup-shaped case, wherein the top plate extends over an open end of the cup-shaped case, the top plate further having a raised annular neck defining an aperture aligned with a centerline axis of the cup-shaped case; and a rim extending outward from an interface between the top plate and the open top end of the cup-shaped case about a periphery of the cartridge.

18. The cartridge of claim 17, further comprising:

a projectile disposed within the aperture defined by the raised annular neck of the top plate; and propellant disposed within an interior of the cup-shaped case.

* * * * *